US005735210A

United States Patent [19]

Rogge et al.

[11] Patent Number: 5,735,210

[45] Date of Patent: Apr. 7, 1998

[54] DOCTOR BLADE UNIT FOR THE INKING SYSTEM OF A ROTARY PRINTING PRESS

[75] Inventors: Günter Rogge, Lienen; Ludger Ottenhues, Tecklenburg, both of Germany

[73] Assignee: Windmöller & Hölscher, Lengerich/Westf., Germany

[21] Appl. No.: 636,859

[22] Filed: Apr. 23, 1996

[30] Foreign Application Priority Data

May 3, 1995 [DE] Germany ..... 195 16 224.2

[51] Int. Cl.[6] ..... B41F 31/05; B41F 31/06

[52] U.S. Cl. ..... 101/366

[58] Field of Search ..... 101/363, 366, 101/364, 350, 148, 351, 352, 207–210; 118/261

[56] References Cited

U.S. PATENT DOCUMENTS

| | | | |
|---|---|---|---|
| 3,128,207 | 4/1964 | Schmitt | 101/169 X |
| 4,290,359 | 9/1981 | Kapoor | 101/148 |
| 5,182,992 | 2/1993 | Rogge . | |
| 5,213,037 | 5/1993 | Leopardi | 101/363 |
| 5,410,961 | 5/1995 | DeNicoloa et al. | 101/363 |
| 5,471,929 | 12/1995 | Rogge et al. . | |

FOREIGN PATENT DOCUMENTS

| | | |
|---|---|---|
| 4001734A1 | 7/1991 | Germany . |
| 88/06097 | 8/1988 | WIPO . |

*Primary Examiner*—J. Reed Fisher

*Attorney, Agent, or Firm*—Evenson, McKeown, Edwards & Lenahan, PLLC

[57] ABSTRACT

A doctor blade unit for the inking system of a rotary printing press consists of a doctor blade carrier, on which two doctor blades that can be brought into contact with an inking roller or screen roller are fastened parallel to one another in the approximate shape of a roof, with said doctor blades limiting an ink chamber in cooperation with the inking roller, the doctor blade carrier and sealing elements provided on the ends of said doctor blade carrier. Ducts for supplying and discharging ink into/out of the ink chamber and contacting units for pressing the doctor blade carrier against the inking roller are also provided. In order to ensure that both doctor blades can be pressed against the screen roller with exactly the same contact pressure, the doctor blade carrier is connected to a doctor blade unit carrier that is provided with the coupling rods of parallel pitman systems. The parallel pitmans are coupled to inking system flames or supports of the inking system flames.

3 Claims, 2 Drawing Sheets

DOCTOR BLADE UNIT FOR THE INKING SYSTEM OF A ROTARY PRINTING PRESS

FIELD OF THE INVENTION

The invention pertains to a doctor blade unit for the inking system of a rotary printing press, with a doctor blade carrier, on which two doctor blades that can be brought in contact with an inking roller are fastened parallel to one another in the approximate shape of a roof, wherein said doctor blades limit an inking chamber in cooperation with the inking roller, the doctor blade carrier and sealing elements provided on the ends of said doctor blade carrier, and with ducts for supplying and discharging ink into/out of the inking chamber as well as contacting gears for pressing the doctor blade carrier against the inking roller.

BACKGROUND OF THE INVENTION

Doctor blade units of this type are, for example, known from DE-4,001,733 A1 and DE-4,001,734 A1.

DE-3,135,711 A1 proposes to suspend the doctor blade unit carrier on bearing blocks in pendulum fashion, namely such that the doctor blades are laterally braced on the outer surface of the inking or screen roller. However, this pendulum-type suspension makes it difficult to realize the contact between both doctor blades and the screen roller with the same contact pressure, due to the kinematics of such a suspension. This is the reason why one doctor blade consists of a more elastic material than the other doctor blade in known doctor blade units of this type. Due to this measure, a superior contact between the doctor blades and the screen roller is also ensured if the doctor blades are not exactly aligned with said screen roller, because the more elastic doctor blade is able to compensate the incorrect adjustment of the doctor blades due to its higher elasticity and flexural softness. However, if both doctor blades have a different elasticity, the doctor blade unit basically cannot be selectively utilized for the clockwise and counterclockwise rotation of a screen roller.

SUMMARY OF THE INVENTION

The invention is based on the objective of developing a doctor blade unit of the type mentioned initially in which both doctor blades can be pressed against the screen roller with exactly the same contact pressure.

According to the invention, this objective is attained in a doctor blade unit of the initially mentioned type by connecting the doctor blade carrier to a doctor blade unit carrier that is provided with coupling rods of parallel pitman systems, and coupling the parallel pitmans to the inking system frames or the carriers of the inking system frames. Since the doctor blade carrier is supported by the coupling rods of parallel pitman systems, said doctor blade carrier remains parallel to itself while it is moved toward the screen roller, i.e., an unacceptably nonuniform contact pressure of the doctor blades on the screen roller is prevented. Although the height of the parallelogram of the parallel pitman system changes during the movement toward the screen roller, this change is negligibly small, particularly if the pitman and the coupler enclose an angle of approximately 90°, and can be taken into consideration during the design of the parallel pitman system. A path change basically only occurs due to the abrasion of the doctor blade edges which needs to be maintained at a minimum anyway.

Each coupling rod is preferably connected in an articulated fashion to the piston rod of a pneumatic cylinder that generates the contact pressure, with said pneumatic cylinder being respectively coupled to one of the inking system frame or the carrier of the inking system frames.

A particularly favorable arrangement is attained if the parallel pitmans of the parallel pitman systems are coupled to pillow blocks in pendulum fashion.

According to an additional development of the invention, it is proposed that the parallel pitmans on one side of the parallel pitman systems are provided with a device that displaces the articulated shaft. This particular embodiment makes it possible to carry out a subsequent adjustment that might be necessary due to the different abrasion of the doctor blades. This displacement device preferably consists of a cam. Consequently, the bearing arrangement can contain a camshaft, the rotation of which raises or lowers the articulated shaft.

According to an additional development of the invention, it is proposed that the pneumatic cylinders that generate the contact pressure are realized in the form of differential piston cylinders, with the cylinder chamber through which the piston rod extends, also being pressurized. The two cylinder chambers are pressurized such that the pneumatic cylinders press the doctor blade carrier against the screen roller with the desired pressure. This contact pressure can be simply caused by subjecting both chambers to the same pressure, with a higher contact pressure being exerted by the cylinder chamber that does not contain the piston rod, namely due to the larger piston surface. Since the cylinder chamber, through which the piston rod extends is also under pressure, undesirable impacts of the doctor blades on the screen roller are prevented, because said impacts are absorbed in an elastic and damping fashion by the second cylinder chamber that is also under pressure.

BRIEF DESCRIPTION OF THE DRAWINGS

An embodiment of the invention is described in detail below with reference to the figures. The figures show.

DETAILED DESCRIPTION OF THE PREFERRED EMBODIMENTS

Figure 1:
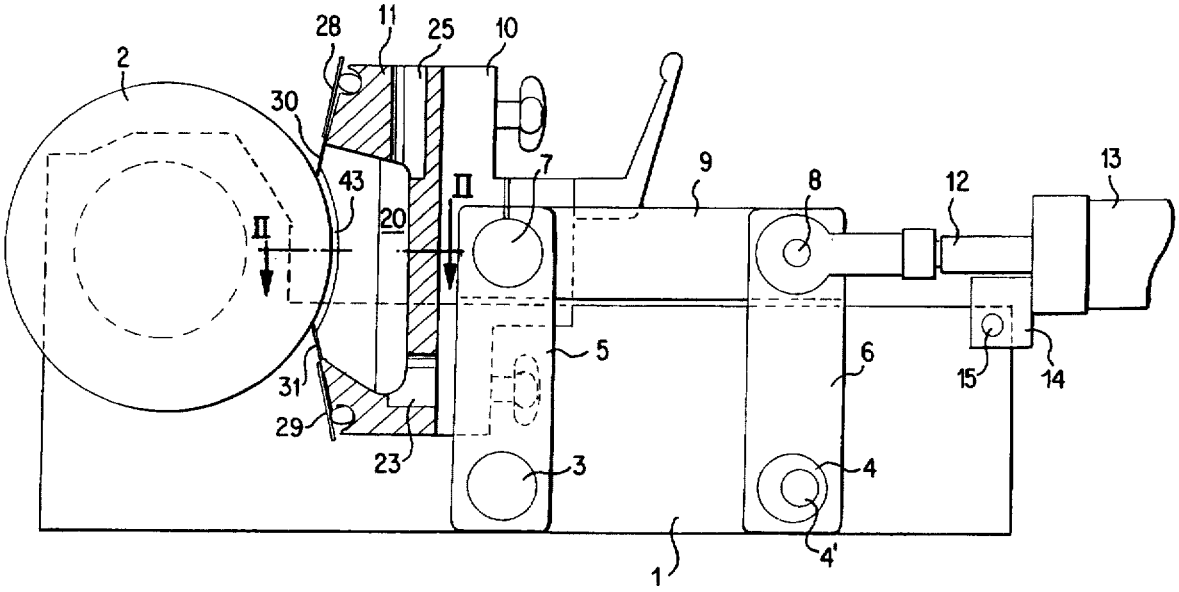
FIG. 1 is a side view of the inking system frame with an ink chamber doctor blade unit that is sectioned along line I—I in FIG. 2.

One side of the screen roller 2 is arranged in customary fashion in the inking system frame 1 that is usually arranged in a movable fashion on the pressure cylinder frame that is also realized in the form of a slide. Consequently, this generally known arrangement is not described in detail.

The parallel pitmans 5, 6 are arranged on the inking system frame 1 such that they can be pivoted around the articulated shafts 3, 4. The upper ends of the parallel pitmans 5, 6 are connected to the carrier 9 that forms a coupler such that they can be pivoted around the articulated shafts 7, 8. The carrier 9 is realized in one piece with the doctor blade unit carrier 10. The doctor blade unit carrier 10 is connected to the doctor blade carrier 11 via screws that are provided with handwheels.

The piston rod 12 of a pneumatic cylinder 13 is connected in an articulated fashion to the carrier 9 or the upper ends of the parallel pitmans 6 in the articulated shaft 8, with said pneumatic cylinder being coupled to the inking system frame 1 via a carrying element 14 and the joint 15.

When moving the doctor blades towards and away from the screen roller, the coupler and the doctor blade carrier 11 remain parallel to one another, because the parallel pitmans 5, 6 have the same length and maintain their parallelism during the pivoting movement.

The articulated shafts 4 of the parallel pitmans 6 are provided with a cam adjustment 4' which makes it possible to raise and lower the pivoting axis of the parallel pitman 6.

The parallel pitmans 5, 6 of each of the two inking system frames that carry the screen roller 2 can be realized in the form of double pitmans in order to increase the stability.

Figure 3:
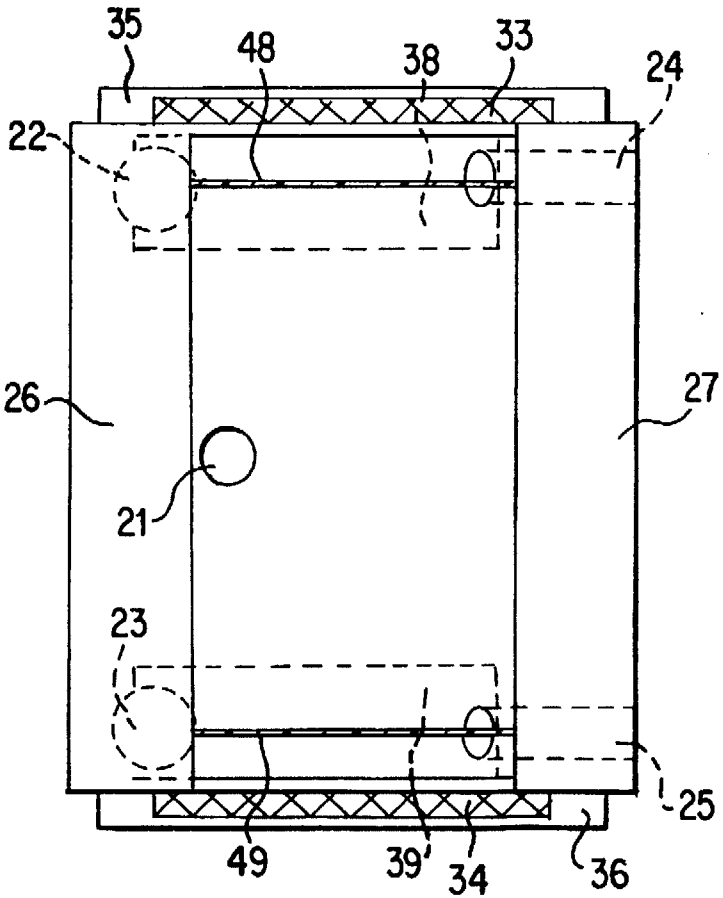
FIG. 3 is a view of the inking chamber doctor blade unit in the direction of arrow A in FIG. 2.
Figure 2:
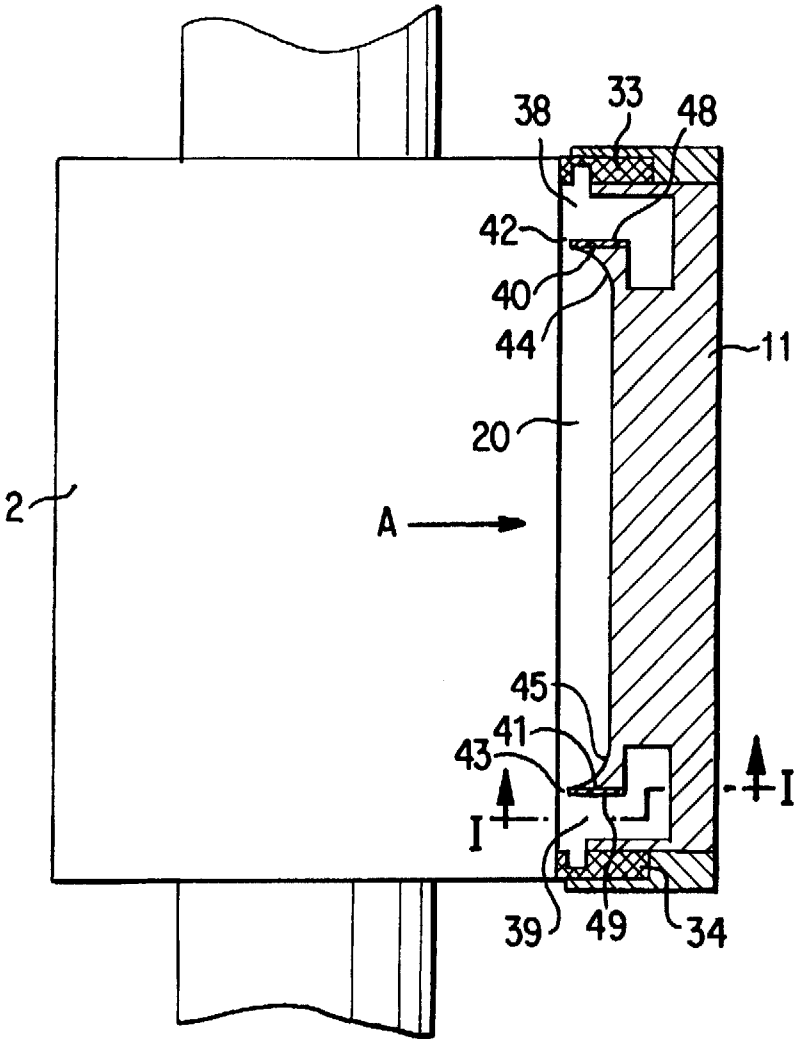
FIG. 2 is a section through the doctor blade carrier along line II—II in FIG. 1.

The doctor blade carrier 11 consists of a profiled rail, the profile of which is shown in FIG. 1. The rail of the doctor blade carrier 11 is provided with a channel 20 that forms the interior of the ink chamber. A bore 21 that supplies the printer's ink ends in this channel within the lower central region as shown in FIG. 3. Bores 22, 23 that serve for discharging the printer's ink are cut into the lower end regions of the aforementioned channel. Ventilation bores 24, 25 end within the upper end regions of this channel.

The faces 26, 27 of the channel edges are mutually beveled in the shape of a roof. The doctor blades 30, 31 are customarily fastened to these faces 26, 27 by means of clamping elements 28, 29. Consequently, this arrangement is not described in detail.

Seals 33, 34 that seal the interior 20 of the ink chamber relative to the screen roller 2 are arranged on the sides of the doctor blade carrier 11. In order to retain these seals in their respective position, covers 35, 36 are connected to the lateral faces of the rail of the doctor blade carrier by means of screws.

The sides of the interior of the ink chamber are provided with chambers 38, 39 that have an approximately L-shaped cross section. These chambers are separated from the central part of the interior of the ink chamber by means of intermediate walls 40, 41, the edges of which that point toward the screen roller 2 define gaps 42, 43 that are curved in the shape of a circle. Beginning at the edges of gaps 42, 43, curved wall parts 44, 45 transform into the central, main part of the interior of the ink chamber.

The lateral chambers 38, 39 are connected to the central part of the interior of the ink chamber via the throttling gaps 42, 43. Consequently, the wall parts 40, 41 also form weirs, through which the ink introduced into the central part of the interior of the ink chamber via the supply bore 21 is admitted into the unpressurized lateral chambers 38, 39 while the pressure is reduced. In order to ensure that the chambers 38, 39 are not pressurized, the ventilation bores 24, 25 end in the aforementioned chambers.

The outer sides of the walls 40, 41 are provided with plastic coatings 48, 49 that slightly protrude beyond the edges that limit the gaps 42, 43, i.e., a metallic contact between said edges and the screen roller 2 is precluded.

What is claimed is:

1. A combination of an inking roller and a doctor blade unit for an inking system of a rotary printing press comprising:

a doctor blade carrier, two doctor blades that can be brought in contact with the inking roller fastened on said doctor blade carrier parallel to and angled toward one another, sealing elements provided on ends of said doctor blade carrier, said doctor blades defining an inking chamber in cooperation with the inking roller, the doctor blade carrier and the sealing elements provided on the ends of said doctor blade carrier, ducts for supplying and discharging ink into and out of the ink chamber, clamping elements for pressing the doctor blade carrier against the inking roller, parallel pitmans, a doctor blade unit carrier, joined to said doctor blade carrier, to which said parallel pitmans are connected, coupling rods joining pairs of said parallel pitmans, articulated shafts coupling said coupling rods to said parallel pitmans, an inking system frame to which the parallel pitmans are coupled, and a device that displaces one of the pairs of said parallel pitmans.

2. A combination according to claim 1, and further comprising a pneumatic cylinder that generates contact pressure coupled with said inking system frame, and a piston rod extending from said pneumatic cylinder for transmitting contact pressure to said coupling rods.

3. A combination according to claim 1, wherein the device that displaces the articulated shafts comprises a cam.

* * * * *